United States Patent [19]

Benedictus

[11] Patent Number: 4,490,907

[45] Date of Patent: Jan. 1, 1985

[54] SHAVING APPARATUS

[75] Inventor: Jan H. Benedictus, Drachten, Netherlands

[73] Assignee: U.S. Philips Corporation, New York, N.Y.

[21] Appl. No.: 487,387

[22] Filed: Apr. 21, 1983

[30] Foreign Application Priority Data

May 6, 1982 [NL] Netherlands ..... 8201848

[51] Int. Cl.[3] ..... B26B 19/42

[52] U.S. Cl. ..... 30/34.2

[58] Field of Search ..... 30/34.2

[56] References Cited

U.S. PATENT DOCUMENTS

| | | | |
|---|---|---|---|
| 2,339,677 | 1/1944 | Burns | 30/34.2 X |
| 3,065,541 | 11/1962 | Bauerle | 30/34.2 X |
| 3,088,205 | 5/1963 | Ellis | 30/34.2 X |
| 4,329,781 | 5/1982 | Schemmann | 30/34.2 |
| 4,336,650 | 6/1982 | Gorter | 30/34.2 |

FOREIGN PATENT DOCUMENTS

| | | | |
|---|---|---|---|
| 2857601 | 10/1980 | Fed. Rep. of Germany | 30/34.2 |
| 2442111 | 7/1980 | France | 30/34.2 |

*Primary Examiner*—Jimmy C. Peters
*Attorney, Agent, or Firm*—Rolf E. Schneider

[57] ABSTRACT

A shaving apparatus comprising a shear plate with apertures and a cutting unit which is drivable relative to the shear plate and comprises a central body provided with cutting elements. Each cutting element has an associated hair-pulling element which precedes the cutting element in the direction of driving. Each combination of a cutting element and an associated hair-pulling element is formed by the limbs of a substantially U-shaped member of a sheet material which may be manufactured as a separate part.

3 Claims, 8 Drawing Figures

SHAVING APPARATUS

The invention relates to a shaving apparatus comprising a shear plate with apertures and a cutting unit associated with and drivable relative to the shear plate and comprises a body provided with cutting elements, a hair-pulling element being associated with each cutting element and preceding said cutting element in the direction of driving.

Such a shaving apparatus is known for example from U.S. Pat. No. 3,962,784. For a satisfactory operation of the apparatus it is necessary that the hair-pulling element is positioned accurately relative to the associated cutting element. If the cutting element and the hair-pulling element are manufactured separately this positioning generally necessitates additional constructional steps and assembly must be effected very carefully.

It is the object of the invention to improve the operation of the shaving apparatus and to reduce the costs of assembling the cutting unit.

The invention is characterized in that each cutting element and associated hair-pulling element are formed by the limbs of a substantially U-section or U-shaped member of a sheet material.

An embodiment of the invention is characterized in that the limbs of the U-section member have end portions which are bent over to extend towards the shear plate in a forward direction with respect to the direction of driving.

Another embodiment is characterized in that portions of said body which are in contact with the cutting elements have projections which contact the shear plate.

Some embodiments of the invention will be described in more detail, by way of example, with reference to the drawings.

Figure 1:
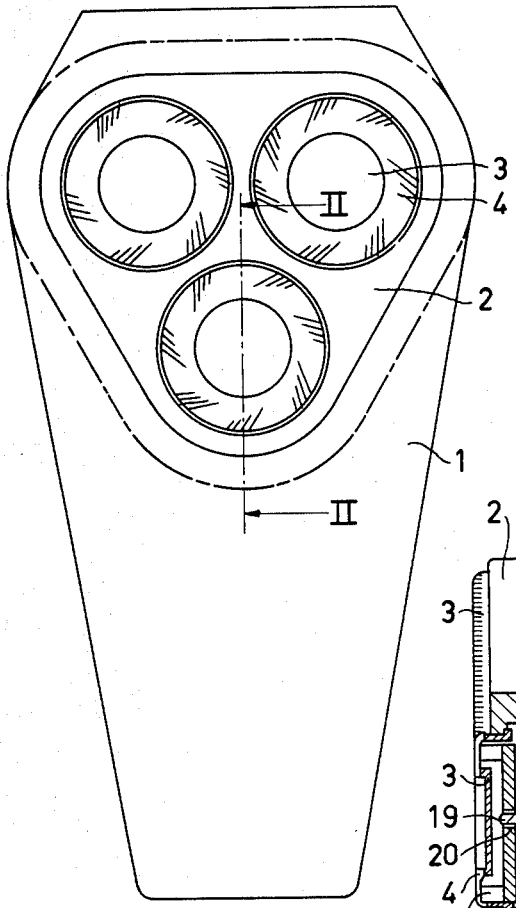
FIG. 1 is a front view of a shaving apparatus comprising three shear plates.
Figure 2:
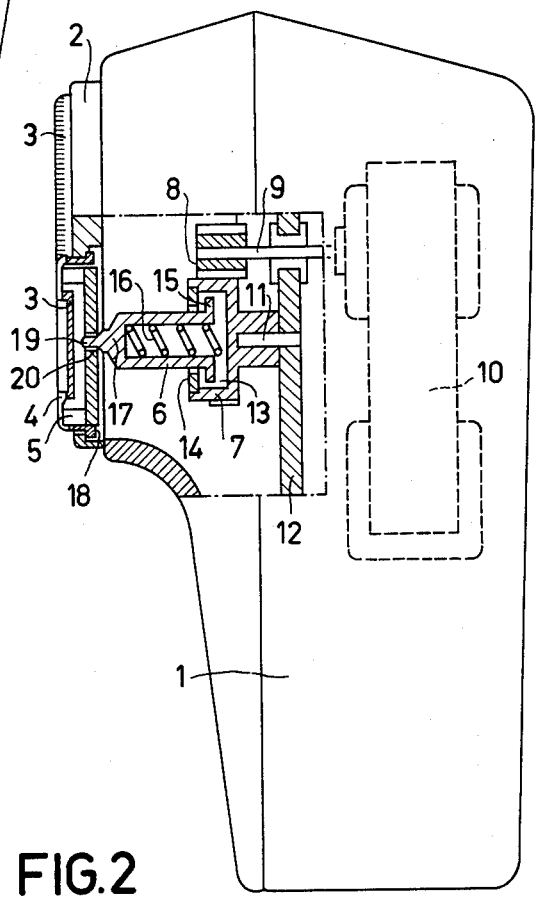
FIG. 2 shows the shaving apparatus of FIG. 1 partly in side view and partly in a sectional view taken on the line II—II in FIG. 1.

The shaving apparatus shown in FIGS. 1 and 2 comprises a housing 1, of which a part takes the form of a shear-plate holder 2 for three shear plates 3. The shear plates 3 are formed with hair-entry apertures 4.

In the partial cross-section in FIG. 2 a cutting unit 5 is shown disposed on the inner side of one of the shear plates 3. For the sake of clarity this cutting unit 5 is shown schematically in FIG. 2 and in perspective and on an enlarged scale in FIG. 3. A similar cutting unit is disposed on the inner side of each of the other two shear plates.

By means of a hollow spindle 6 (FIG. 2), gear wheels 7 and 8 and a spindle 9 the cutting unit 5 is coupled to an electric motor 10 to be rotated thereby relative to the associated shear plate 3. The gear wheel 7 is rotatably mounted on a pin 11 which is secured in a mounting plate 12. The gear wheel 7 is formed with a recess 13 which is closed by a cover plate 14. This recess receives a flange 15 at the end of the hollow spindle 6. By giving the flange 15 a non-circular, for example square, shape and the recess 13 a corresponding shape, a coupling is obtained for transmitting the rotary movement of the gear wheel 7 to the spindle 6. The spindle is tiltable in all radial directions. A spring 16, which for the greater part is situated in the hollow spindle 6 and which acts between the hollow spindle 6 and the gear wheel 7, exerts a force on the spindle 6 towards the unit 5. A conical portion 17 of the spindle 6 bears against the cutting unit 5 so that this force is transmitted to the cutting unit and via the cutting unit to the shear plate 3 to urge a flange 18 on the shear plate against the shear-plate holder 2. External forces which may occur during the use of the shaving apparatus can thus press the shear plate 3, together with the cutting unit 5 and the spindle 6, inwards against the action of the spring 16.

A coupling for transmitting the rotary movement between the spindle 6 and the cutting unit 5 is obtained by giving the spindle 6 an end portion 19 of substantially rectangular cross-section for cooperation with a correspondingly shaped coupling aperture 20 in the cutting unit 5.

All three cutting units of the apparatus shown in FIGS. 1 and 2 are coupled to the motor 10 in the above manner, the three gear wheels 7 meshing with the single centrally arranged gear wheel 8 on the motor spindle 9.

Each cutting unit 5 (FIG. 3) comprises a body 21 which carries cutting elements 22. Each cutting element 22 has an associated hair-pulling element 23 which precedes the cutting element in the direction of driving P. Each cutting element 22 and associated hair-pulling element 23 are formed by the limbs of a substantially U-section member 24 of a sheet material, which member is arranged in an associated slot 25 in the body 21. The member 24 may, for example, be cemented in the slot 25. The cutting unit comprises a plurality of such U-section members, for example six or twelve, which are regularly spaced around the circumference of the body 21.

The distal end portions 26 and 27 of each cutting element 22 and hair-pulling element 23 respectively are bent over and their end faces 28 and 29 are partially bounded by sharp edges 30 and 31 respectively.

Figure 4:
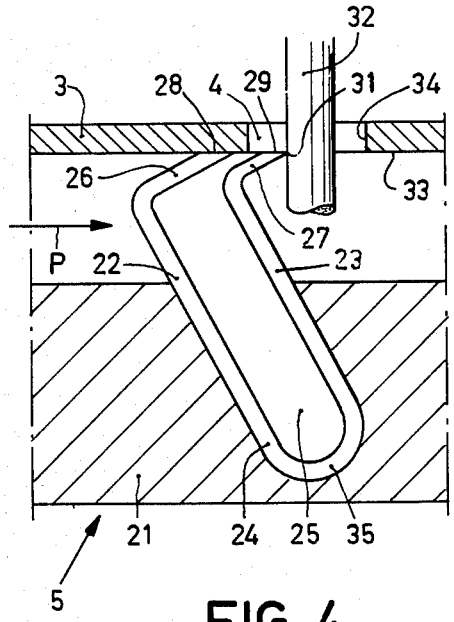
FIGS. 4 and 5 illustrate the operation of the hair-pulling blades of the cutting unit shown in FIG. 3.
Figure 5:
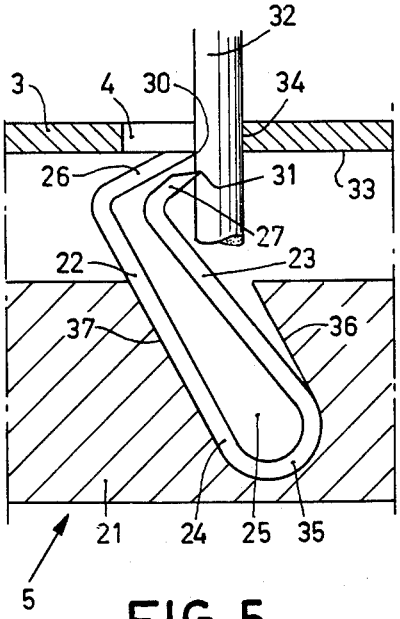

FIGS. 4 and 5 illustrate the operation of the apparatus and show part of a cutting unit 5 in side view, which part comprises a single combination of a cutting element 22 and a hair pulling element 23, part of the shear plate 3 with an aperture 4 in which a hair 32 is situated being shown in cross-section. The end portions 26 and 27 of the cutting element 22 and hair-pulling element 23 extend towards the shear plate in a forward direction with respect to the direction of driving P and their end faces 28 and 29 are in contact with the underside 33 of the shear plate 3. FIG. 4 shows the situation at the instant at which the hair-pulling element 23 reaches the hair 32. The sharp edge 31 will penetrate the hair 32 slightly and press it against the wall 34 of the aperture 4. As a result of the reaction forces exerted on the hair-pulling element 23 by the hair 32 the hair-pulling element will deflect elastically so that the end portion 27 thereof is moved away from the shear plate, pulling the hair 32 in the same direction.

The U-section member 24 is mounted in the associated slot 25 in such a way that the connecting portion 35 between the two limbs of the member 24 can be considered to be rigidly connected to the body 21. During the above-described deflection of the hair-pulling element 23 this hair pulling element moves off the wall 36 of the slot 25.

FIG. 5 shows the situation at the instant at which the sharp edge 30 of the cutting element 22 reaches the hair 32. This cutting element is supported over a large part of its length by a wall 37 of the slot 25, so that substantially no elastic deflection of the cutting element can occur. Consequently, the hair 32 is severed by cooperation between the shear plate 3 and the cutting element 22 after the hair has been pulled further through the aperture 4 in the shear plate by the hair-pulling element 23, which results in a substantial improvement in the shaving action of the shaving apparatus.

Mounting the cutting unit 5 is very simple because the U-section members 24 may be manufactured separately from a metal sheet by a stamping and bending operation. The cutting element and hair-pulling element formed by each U-section member 24 are then already in the correct positions relative to each other, so that the U-section members need only be inserted in the slots in the body 21. The body 21 may be manufactured from, for example, a light metal or metal alloy or a plastics material.

Figure 3:
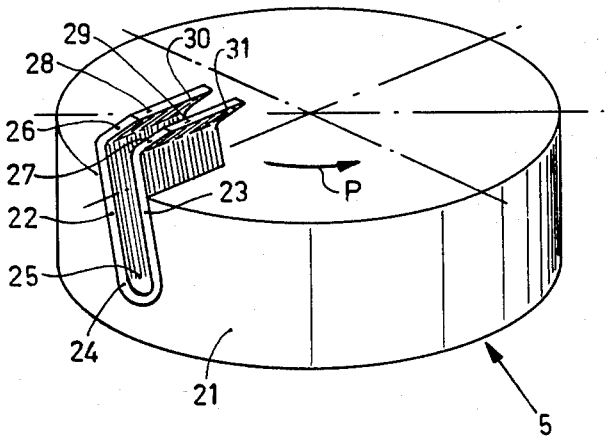
FIG. 3 is a perspective view on an enlarged scale of one of the cutting units of the shaving apparatus of FIG. 1.
Figure 6:
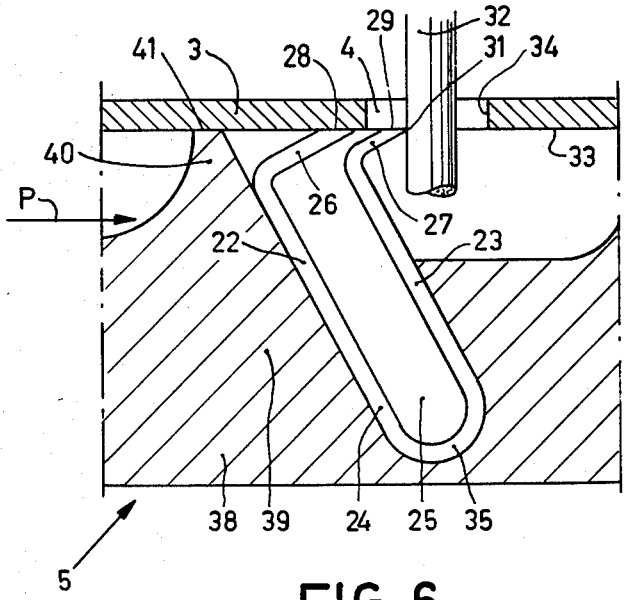
FIG. 6 shows a variant of the embodiment shown in FIGS. 3 to 5.

FIG. 6 is a view similar to that shown in FIG. 4, showing a variant of the embodiment shown in FIGS. 3 to 5. The difference only concerns the body 38 of the cutting unit 5. This body 38 comprises portions 39 which are in contact with the cutting elements 22 and which have projections 40 with end faces 41 which contact the underside 33 of the shear plate 3. In this way the body 38 supports both the cutting elements 22 and the shear plate 3. Forces acting between the shear plate 3 and the cutting unit 5 are transferred directly from the shear plate to the body 38 and not via the vulnerable cutting elements and hair-pulling elements. The total surface area of the end faces 41 may be larger than the total surface area of the end faces 28 and 29 of the cutting elements and the hair-pulling elements, so that surface pressures between the shear plate 3 and the body 38 are reduced. As the combinations of cutting elements and hair-pulling elements may be manufactured as separate parts, different materials may be used for these parts and the body 38. For example, for the body 38 a material with a low friction coefficient may be used, for example a plastics material, so that the friction losses between the shear plate and body 38 are low. Since the cutting elements and the hair-pulling elements do not have to transmit forces and the surface pressures between the shear plate and the body 38 are low, both the shear plate 3 and the members 24 may be manufactured from a very thin sheet material, which simplifies the manufacture of these parts, reduces the reject percentage and consequently reduces the manufacturing costs.

Figure 7:
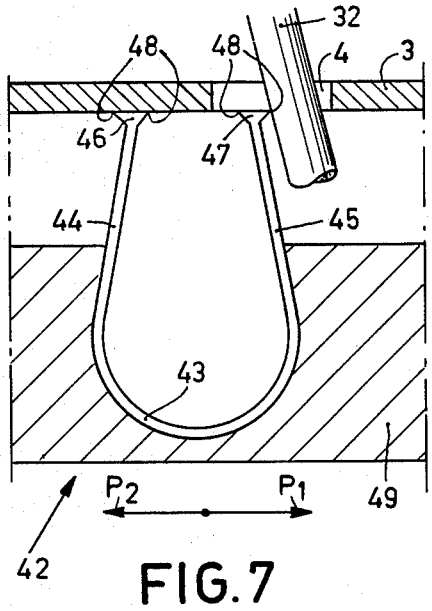
FIGS. 7 and 8 illustrate in a manner similar to FIGS. 4 and 5 the operation of an embodiment comprising a cutting unit which is arranged to be driven with a reciprocating motion.
Figure 8:
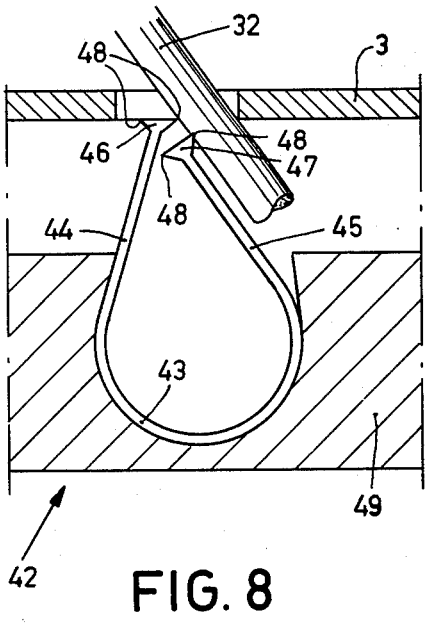

FIGS. 7 and 8, in a manner similar to FIGS. 4 and 5, illustrate the operation of an embodiment having a cutting unit 42 which is reciprocated in the directions $P_1$ and $P_2$. Again a U-section member 43 is used, whose limbs 44 and 45 each act alternately as a cutting element and a hair-pulling element. The limbs 44 and 45 are provided with broadened portions 46 and 47 at their respective distal ends, each portion 46 and 47 being bounded by sharp edges 48 on both sides. FIG. 7 shows the situation at the instant at which the limb 45, which in the case of driving in the direction $P_1$ functions as a hair-pulling element, encounters the hair 32. In FIG. 8 the limb 44, which in this direction of driving constitutes the cutting element, has reached the hair 32 and will sever it. When the cutting unit 42 moves in the direction $P_2$ the functions of the limbs 44 and 45 are reversed. Again, a plurality of U-section members 43 may be mounted in a common body 49.

What is claimed is:

1. A shaving apparatus comprising a shear plate with apertures and a cutting unit which is drivable relative to the shear plate and comprises a body provided with cutting elements, a hair-pulling element being associated with each cutting element and preceding said cutting elements in the direction of driving, characterized in that each cutting element and associated hair-pulling element are formed by the limbs of a substantially U-section member of a sheet material.

2. A shear plate as claimed in claim 1, characterized in that the limbs of the U-section member have end portions which are bent over to extend towards the shear plate in a forward direction with respect to the direction of driving.

3. A shaving apparatus as claimed in claim 1, characterized in that portions of said body which are in contact with the cutting elements have projections which contact the shear plate.

* * * * *